US007669637B2

(12) United States Patent
Kubota et al.

(10) Patent No.: US 7,669,637 B2
(45) Date of Patent: Mar. 2, 2010

(54) IMPELLER FOR SUPERCHARGER AND METHOD OF MANUFACTURING THE SAME

(75) Inventors: Yasuhiro Kubota, Matsue (JP); Hirokazu Itoh, Higashiizumo (JP)

(73) Assignees: Hitachi Metals Ltd., Tokyo (JP); Hitachi Metals Precision, Ltd., Tokyo (JP)

( * ) Notice: Subject to any disclaimer, the term of this patent is extended or adjusted under 35 U.S.C. 154(b) by 919 days.

(21) Appl. No.: 10/573,966

(22) PCT Filed: Mar. 30, 2005

(86) PCT No.: PCT/JP2005/006107

§ 371 (c)(1), (2), (4) Date: Mar. 30, 2006

(87) PCT Pub. No.: WO2005/116454

PCT Pub. Date: Dec. 8, 2005

(65) Prior Publication Data

US 2006/0291996 A1 Dec. 28, 2006

(30) Foreign Application Priority Data

May 28, 2004 (JP) ..... 2004-159209

(51) Int. Cl.
*B22C 9/04* (2006.01)
*B22D 33/04* (2006.01)

(52) U.S. Cl. ..... 164/35; 164/45; 164/137; 164/339

(58) Field of Classification Search ..... 164/34, 164/35, 45, 516, 137, 339, 342
See application file for complete search history.

(56) References Cited

U.S. PATENT DOCUMENTS

| | | | | | |
|---|---|---|---|---|---|
| 4,975,041 | A | * | 12/1990 | Fries et al. | 425/547 |
| 6,019,927 | A | * | 2/2000 | Galliger | 264/221 |
| 6,123,539 | A | * | 9/2000 | Miller | 425/589 |
| 2002/0187060 | A1 | * | 12/2002 | Decker et al. | 417/407 |

FOREIGN PATENT DOCUMENTS

| | | | | |
|---|---|---|---|---|
| JP | 63-171242 | A | | 7/1988 |
| JP | 2002-113749 | A | * | 4/2002 |
| JP | 2002-336932 | A | | 11/2002 |
| JP | 2004-52724 | A | | 2/2004 |

* cited by examiner

*Primary Examiner*—Kevin P Kerns
(74) *Attorney, Agent, or Firm*—Sughrue Mion, PLLC

(57) ABSTRACT

A lost-wax cast impeller for a supercharger having no parting line on a hub surface and a blade surface in each space demarcated by pairs of long blades adjacent to each other and having excellent aerodynamic performance. A method of manufacturing the impeller involves forming a lost form pattern in substantially the same shape as the impeller, forming a mold by eliminating the lost form pattern after the lost form pattern is coated with a refractory, and pouring a molten metal in the mold for casting. In the molding step, lost material is injection-molded in a space demarcated by radially arranging, toward a center shaft, a plurality of slide molds having short blade-shaped bottomed groove parts and space shapes between the pairs of long blades adjacent to each other, and the slide molds are released by moving in the radial direction of the center shaft while rotating.

11 Claims, 4 Drawing Sheets

IMPELLER FOR SUPERCHARGER AND METHOD OF MANUFACTURING THE SAME

TECHNICAL FIELD

The present invention relates to an impeller for superchargers, for example, an impeller of a supercharger which is used in an intake side of the supercharger for feeding compressed air by utilizing an exhaust gas from an internal combustion engine. The present invention also relates to a method of manufacturing an impeller for superchargers.

BACKGROUND ART

A supercharger incorporated in an engine of an automobile or the like is adapted to supply compressed air to the engine to increase an engine power output by rotating an impeller at an exhaust side by an exhaust gas from the engine to rotate another impeller disposed in an intake side coaxially with the impeller at the exhaust side. Since the exhaust side impeller is exposed to the high temperature exhaust gas discharged from the engine, it has been made from a heat resisting Ni-based superalloy by a lost wax casting process because of its less complicated form. On the other hand, since the intake side impeller is not exposed to a high temperature and hence, it is made mainly of an aluminum alloy. In recent years, however, since the impeller is required to rotate under a higher speed in order to improve the combustion efficiency, a titanium alloy has been tried for use because of its light weight and a high strength. Further, a magnesium alloy has been also tried for use because it will be able to realize a much more weight reduction as compared with the titanium alloy.

In many cases, the intake side impeller has a complicated blade form in which a plurality of full and splitter blades of two types different in form from each other are usually arranged alternately and adjacent to one another in order to provide an increase in compression rate of the compressed air. In the case of a cast impeller made of an aluminum alloy, it has been produced by a plaster molding process wherein a plaster casting mold is used, which mold is produced with utilization of an elastic rubber pattern. An impeller made of a magnesium alloy can be also produced by the plaster molding process. Such a rubber pattern is produced by the following process consisting of producing a master pattern of a impeller; producing a casting mold with utilization of the master pattern; and injecting a silicone-based rubber into the casting mold. According to the rubber pattern, it is possible to reproduce a complicated form of the master pattern while having a small problem in dimensional accuracy.

On the other hand, when an active metal such as a titanium alloy is cast by the plaster molding process, a plaster mold and a molten titanium alloy react heavily with each other, so that such casting is impossible. Thus, an impeller of a titanium alloy has been produced from a cast material by five-axis machining. However, since the titanium alloy is hard to machine, such machining is expensive and unsuitable to mass production. Therefore, with regard to the case of the titanium alloy, it has been tried to use the lost wax casting process according to which it is possible to use a ceramic shell such as zirconia and yttria stable to the titanium alloy.

In the lost wax casting process, it is necessary to produce a sacrificial pattern having the same form as a final product of an impeller by a die casting method. For example, according to a publication of US-2002-0187060-A1 (corresponding to JP-A-2003-94148), there is proposed a titanium compressor impeller produced by a lost wax casting process, in which the blade form is redesigned so that die inserts (i.e. slide dies) can be drawn out of blade portions of a sacrificial pattern. (*Note: In the publication, the casting is referred to as an investment casting.) This proposal is excellent in the point that titanium alloy impellers can be produced relatively inexpensively in mass production.

DISCLOSURE OF THE INVENTION

Problems to be Solved by the Invention

According to the process disclosed in the above patent publication, however, the blade form is redesigned so that the slide dies which move two-dimensionally can be withdrawn from the sacrificial pattern. Thus, the blade form is extremely limited, and it is difficult to manufacture an impeller with a complicated form having a high aerodynamic performance.

It is also proposed in the patent publication that in the case of an impeller having full and splitter blades arranged alternately adjacent to one after another, each area between the full and splitter blades is formed by one, two or three slide dies, and the die(s) is released or withdrawn from the sacrificial pattern. In this case, the die structure is complicated, so that it is hard to obtain a high dimensional accuracy. Further, the more the number of the dies increases, the more the number of parting lines at parting faces between the dies generated on a hub surface between blades and on blade surfaces increases, whereby parting line-correspondence portions of the impeller might hinder the flow of air between the blades resulting in an adverse effect to the aerodynamic performance.

Thus, an object of the present invention is to provide an impeller for superchargers and a method of manufacturing the same, whereby the above problems can be solved, and a high aerodynamic performance is expectable.

Means for Solution of Problems

The present inventors made an attempt to produce an impeller having a form with an undercut extending radially from the center axle by a lost wax casting process, and examined the application of slide dies having a particular structure and the optimization of the releasing motion of the slide dies, whereby attaining the present invention.

More specifically, the invention is directed to a method of manufacturing an impeller for superchargers by a lost wax casting process, the impeller comprising a disk-shaped hub extending radially from a center axle, and a plurality of blades extending from the hub, which blades consist of alternately arranged full and splitter blades each having an aerodynamic curved surface, wherein a space defined by an each pair of the adjacent blades forms an undercut extending radially from the center axle, wherein the method comprises the following steps of:

(a) forming a sacrificial pattern having substantially the same form as the impeller, (b) coating the sacrificial pattern with a refractory material and subsequently thermally removing the sacrificial pattern to form a casting mold, and (c) casting the impeller with utilization of the casting mold, and wherein the step (a) of forming the sacrificial pattern is a process of injecting a sacrificial material into a cavity defined by a plurality of slide dies which are arranged radially toward the center axle, and each of which has a groove, having a bottom of the same form as the splitter blade, and a form corresponding to that of a space between an adjacent pair of the full blades; and subsequently moving the slide dies radially outwardly, while rotating themselves thereby releasing them from the sacrificial pattern.

In the present invention, a die device used in the step of forming the sacrificial pattern comprises a movable die which moves in a direction of a center axle of forming the sacrificial pattern, a stationary die, the slide dies movable radially with respect to the center axle, and slide supports for supporting the slide dies, whereby the slide dies can be moved in conjunction with one another by driving the slide supports.

Each of the slide dies is comprised of a plurality of cores bonded integrally with one another. Motional lines for releasing each of the slide dies from the sacrificial pattern are a motional line on XY coordinates on a two-dimensional plane, to which the center axle of the impeller is a perpendicular, and a motional line including a rotational component around the motional line on the XY coordinates.

The casting mold can be formed by coating the sacrificial pattern with any one of zirconia-based, yttria-based and calcia-based refractories, further coating the sacrificial pattern with any one of silica-based, alumina-based and zircon-based refractories, drying the refractory materials, thermally removing the sacrificial pattern in an autoclave, and calcining the resultant refractory materials at a high temperature.

According to the above manufacturing method, parting line-correspondence portions can be formed in the spaces defined by the blades only on a trailing edge face, a fillet face and a leading edge face by which an outer periphery of the respective full blade is defined. Thus, a new impeller for superchargers can be provided, which has no parting line-correspondence portion on any of a hub surface and blade surfaces in the space defined by the blades resulting in excellent aerodynamic performance of the impeller.

Namely, the invention impeller for superchargers, which is produced by a lost wax casting method, comprises the center axle, the disk-shaped hub extending radially from the center axle, and the plurality of blades extending from the hub, which blades consist of alternately arranged full and splitter blades each having an aerodynamic curved surface, wherein the space defined by the each pair of the adjacent blades forms the undercut extending radially from the center axle, and wherein there are present the parting line-correspondence portions in the respective space defined by the adjacent pair of full blades and only on a trailing edge face, a fillet face and a leading edge face by which an outer periphery of the respective full blade is defined.

In the present invention, the impeller for superchargers may be made of a titanium alloy by casting the titanium alloy in a casting mold under the lost wax casting process.

In the present invention, it is possible to use any common casting materials including an aluminum alloy, a magnesium alloy and a ferrous alloy other than the titanium alloy. Particularly, the titanium alloy is suitably used in the present invention because of a light weight and high strength.

Effect of the Invention

According to the present invention, it is possible to provide the impeller for superchargers in which no parting line-correspondence portion is present on the hub surface and the blade surfaces in the space defined by the blades, and which is excellent in aerodynamic performance. This is extremely effective in industries.

BEST MODE FOR CARRYING OUT THE INVENTION

Figure 1:
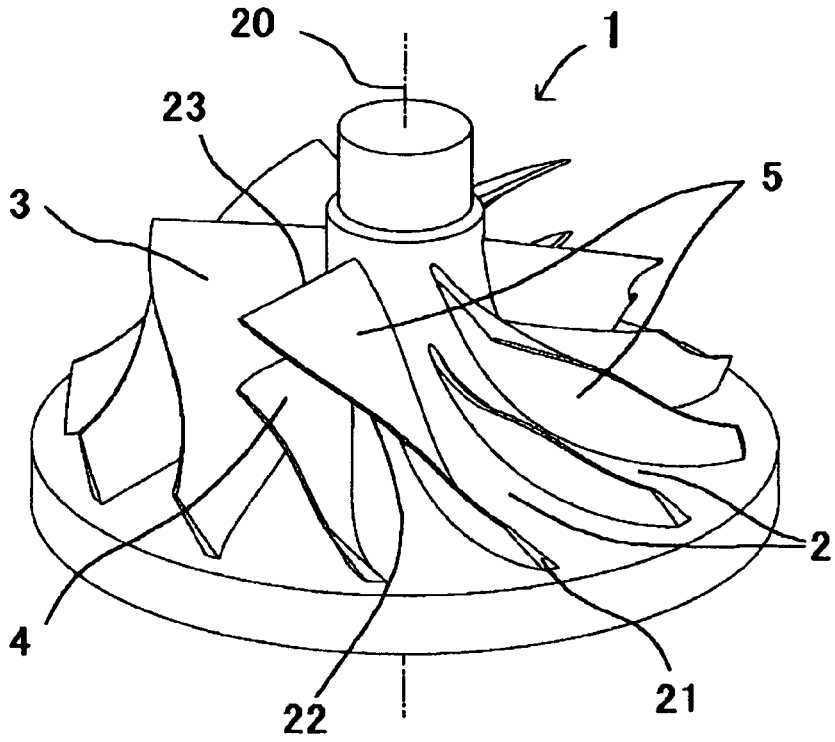
FIG. 1 schematically shows one example of an impeller for superchargers.

As described above, the important feature of the present invention, for an attempt made to manufacture an impeller of a form with an undercut formed in a radial direction from a center axle by utilizing the lost wax casting process, resides in the application of a slide die having a particular structure during manufacture of a sacrificial pattern and in the optimization of the releasing motion of the slide die.

More specifically, employed as a step for forming a sacrificial pattern is a step which comprises injection-molding a sacrificial material in a space demarcated or defined by radially arranging, in an opposed manner toward a center axle, a plurality of slide dies each having a splitter blade-shaped bottomed groove and a form corresponding to that of a space between adjacent full blades, and then moving the slide dies in a radial direction of the center axle, while rotating them, thereby releasing the slide dies.

The slide die, which is one of the important features of the present invention, includes a splitter blade-shaped bottomed groove and a form corresponding to that of a space between adjacent full blades, and the space defined between the full blades including the splitter blade, i.e., in brief, the space of an extent corresponding to two blades can be formed by one slide die.

Namely, the splitter blade-shaped bottomed groove is a cavity for forming the splitter blade, and the space demarcated or defined by arranging the plurality of slide dies radially toward the center axle are a cavity for determining the forms of the full blade and the center axle. Thus, cavities having substantially the same form as the impeller for the supercharger can be formed.

By defining the space of the extent corresponding to an each pair of the adjacent full blades by the single slide die in this manner, the die device can be simplified, and in this space, a parting line-correspondence portion can be provided on only a trailing edge face, a fillet face and a leading edge face defining an outer periphery of the blade. Thus, no parting line is present in this space and hence, no parting line-correspondence portion is present on a hub surface and a blade surface in the space defined by the blades in the produced cast impeller.

In the present invention, the sacrificial material is injection-molded into the slide dies disposed in the above manner. However, the injection-molding is intended for a form with an undercut formed radially, and hence, even if an attempt is made to move the slide dies in a two-dimensional space formed in the radial direction of the center axle for releasing of them, the releasing cannot be achieved.

Therefore, in the present invention, the slide dies are moved, while being rotated, whereby they are released.

More specifically, by ensuring that motional lines for releasing of each of the slide dies from the sacrificial pattern are a motional line on XY coordinates on a two-dimensional plane, to which the center axle of the impeller is a perpendicular, and a motional line including a rotational component around the motional line on the XY coordinates, the releasing of the dies can be achieved even in the case of the form with the undercut formed radially. Depending on the blade form, the motion for further moving the slide die in a direction of a Z-ordinate which is a direction toward the center axle may be added.

Then, the sacrificial pattern produced in the above manner is coated with a refractory and thereafter, the sacrificial pattern is removed in a lost manner by a technique such as heating. Further, the remaining refractory is calcined, whereby a casting mold having a high strength can be also produced. Thus, an impeller having substantially the same form as the sacrificial pattern can be produced by casting a molten metal such as a titanium alloy, an aluminum alloy and a magnesium alloy into the casting mold.

The impeller for superchargers produced by the above-described manufacturing method is excellent in aerodynamic performance, because no parting line-correspondence portion is present in any of the hub surface and the blade surfaces in the space defined by the blades.

Figure 2:
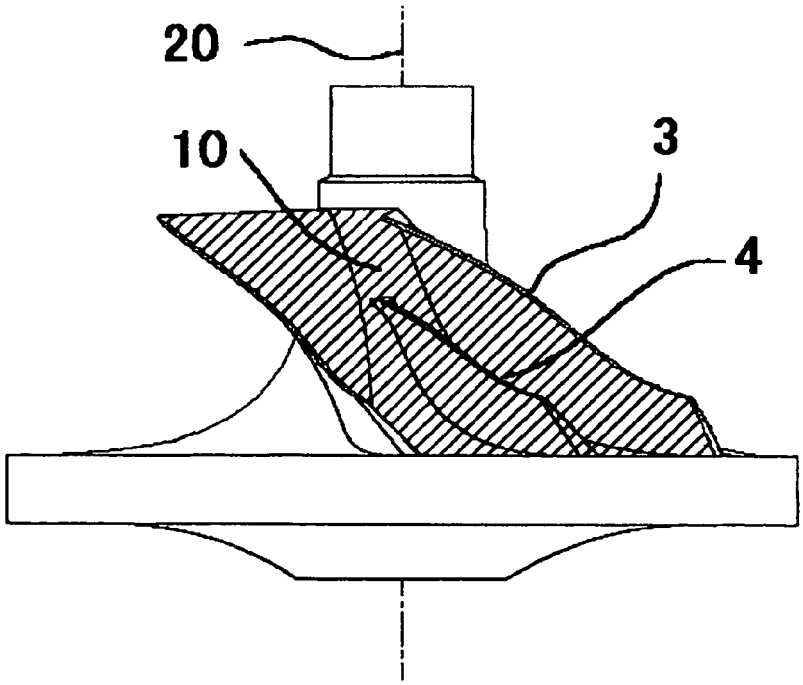
FIG. 2 is a schematic drawing of one example of a blade.

The impeller for the supercharger of the present invention will now be described by way of particular examples with reference to the drawings. At first, the form of the impeller for the supercharger will be described by way of one example. FIG. 1 is a diagrammatic illustration of an impeller 1 for superchargers including blades comprising full blades 3 and splitter blades 4 disposed alternately adjacent one another and used in a supercharger for an internal combustion engine. FIG. 2 is a schematic diagram of the impeller 1 (for clarity, two full blades and one splitter blade are shown). Pluralities of the full blades 3 and splitter blades 4 are projectingly mounted on a hub surface 2 spreading radially from a center axle 20. The full blade 3 and the splitter blade 4 have blade surfaces 5 of complicated aerodynamic curved-surface form on obverse and reverse, respectively.

In FIG. 1, the blade surface 5 is a curved surface which does not include a trailing face 21 and a fillet face 22 corresponding to radially outer peripheral surfaces of the full blade 3 and the splitter blade 4 and further a leading edge face 23 corresponding to an uppermost portion of each of the full blade 3 and the splitter blade 4. The hub surface 2 and the blade surface 5 in the space defined by the blades comprising the full blades 3 and the splitter blades 4 correspond to portions shown by oblique lines in FIG. 2.

The blade surface referred to in the present invention means a curved surface portion which does not include a trailing face 21 and a fillet face 22 defining an outer peripheral surface of the full blade 3 and further a leading edge face 23 corresponding to an uppermost portion of the full blade 3, for example, in the impeller 1 for the supercharger shown in FIG. 1.

The parting line referred to in the present invention means a difference in level formed on parting faces of a die device and a linear trace generated by insetting of a sacrificial pattern material into a parted section of the die device. When a parting line is generated in the sacrificial pattern, the parting line is transferred, as it is, as a parting line-correspondence portion even in a cast product (an impeller in the present invention). In other words, if no parting line is formed in the sacrificial pattern, a parting line-correspondence portion cannot be formed even in a cast product.

The slide die applied in the present invention and having the splitter blade-shaped bottomed groove and the form of the space between the adjacent full blades may be any one, if it is movable with the sacrificial pattern during the releasing thereof. The slide die may be fabricated monolithically, but may be made by producing a plurality of cores and then bonding them integrally by bolting, brazing or the like. For example, a slide die shown in FIG. 5 is constructed integrally by bonding two cores 25 and 26 to each other by a joint surface.

This is because if an attempt is made to produce cavities of grooves each having a bottom for forming splitter blades of thin members each having a curved surface, it is difficult in many cases to produce the die only machining the grooves, and hence the dividing method of producing the slide die makes the production easier.

Figure 3:
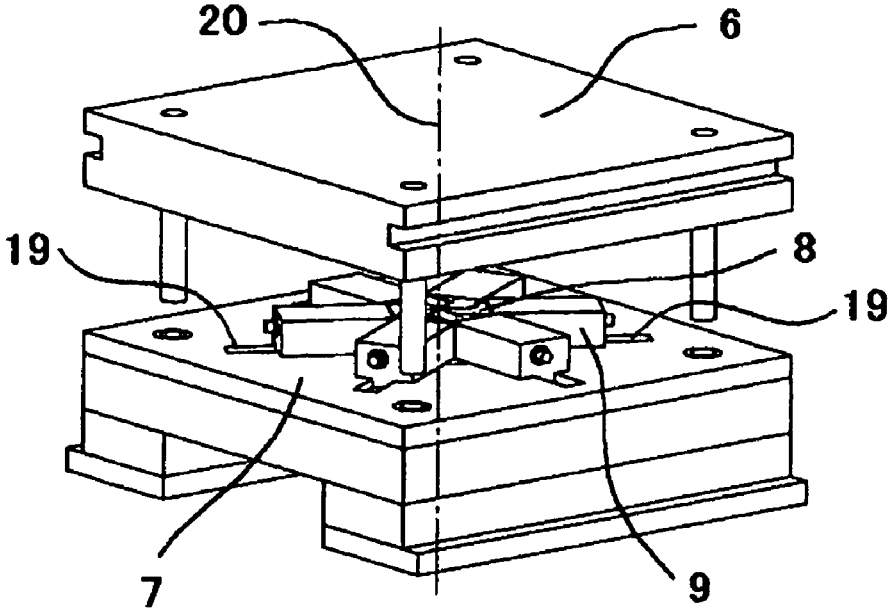
FIG. 3 is an overall view of one example of a die device.

The impeller for the supercharger shown in FIG. 1 is produced using a lost wax casting process by the following steps: At first, a sacrificial pattern is formed by an injection molding using a die device. This step is a most important step in the manufacturing method of the present invention. One example of a die device applied in the present invention is shown in FIG. 3. The die device is comprised of a movable die 6 openable and closable in a direction toward the center axle 20 of the impeller, a stationary die 7, a plurality of slide dies 8 movable radially with respect to the center axle 20 of the impeller, and a plurality of slide supports 9 for supporting the slide dies 8.

Figure 4:
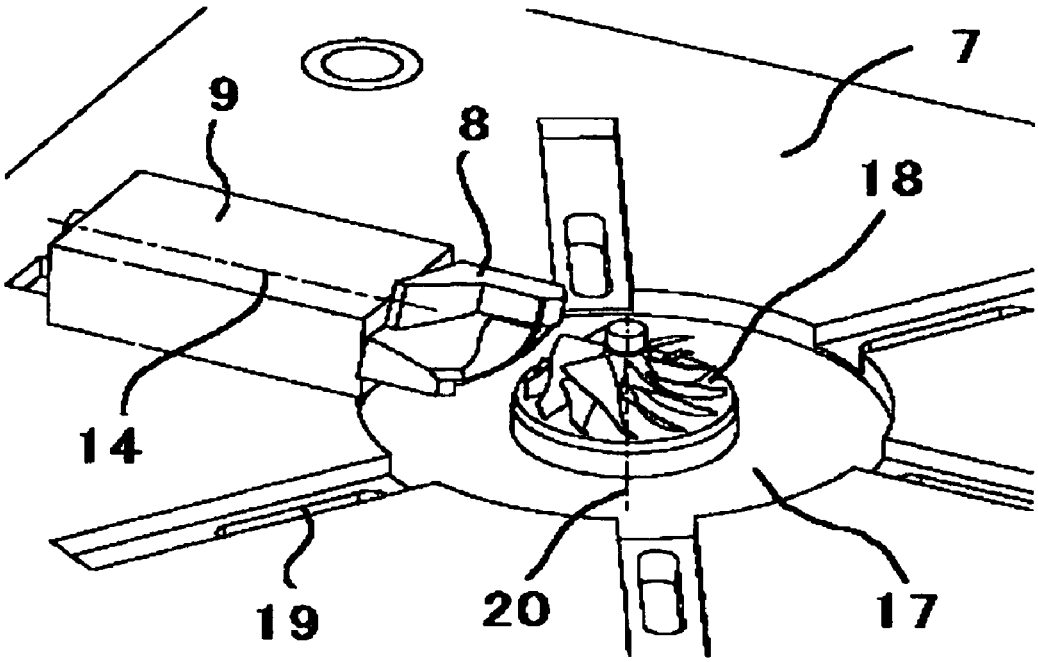
FIG. 4 shows an essential portion of one example of a stationary die.
Figure 5:
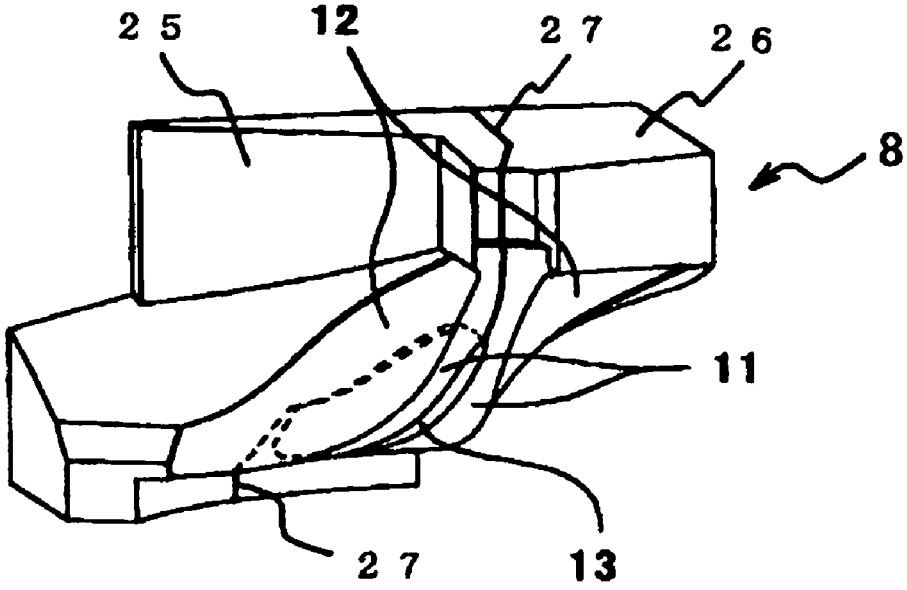
FIG. 5 schematically shows one example of a slide die.

FIG. 4 is a perspective view of essential portions of the stationary die 7 (for clarity, one of the slide dies 8 and one of the slide supports 9 are only shown), and FIG. 5 is a diagrammatical illustration of the slide die 8. One slide die 8 is comprised of parts: a hub cavity-defining portion 11, a blade cavity-defining portion 12 and a bottomed groove cavity-defining portion 13 (shown by a dotted line). The hub cavity-defining portion 11 defines a hub surface 2 in a space made between adjacent full blades and including one splitter blade. The blade cavity-defining portion 12 defines two opposed blade surfaces 5 of the adjacent full blades, and a trailing edge face 21, a fillet face 22 and a leading edge face 23 forming parting lines in a space defined by the blades. The bottomed groove cavity-defining portion 13 defines a splitter blade. Namely, one slide die defines a form corresponding to a space 10 shown by oblique lines in FIG. 2.

Figure 6:
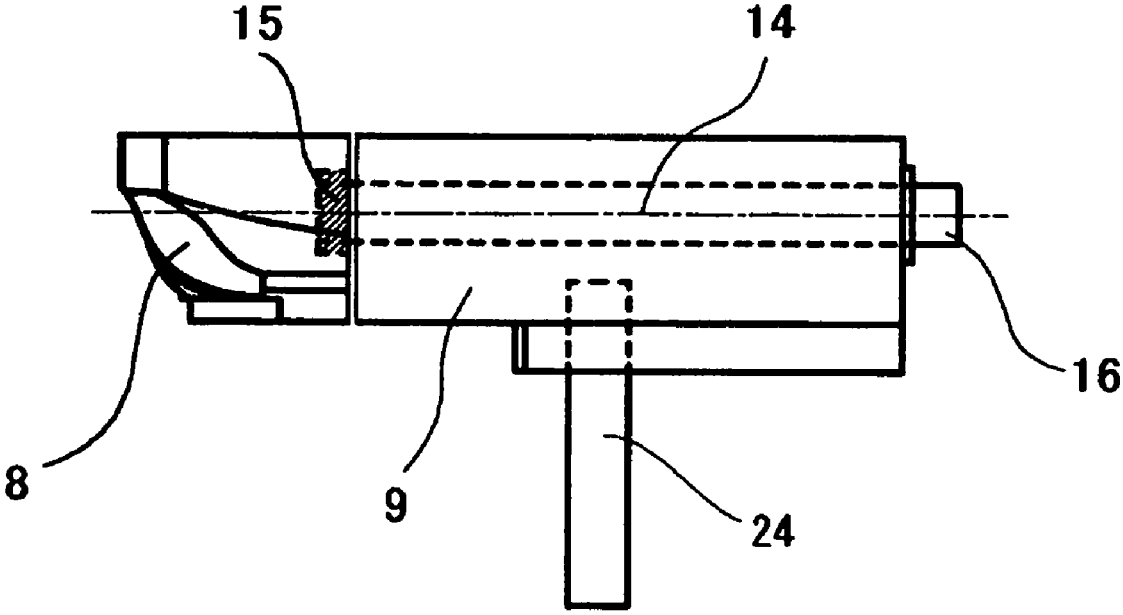
FIG. 6 is a side view showing one example of a bonding structure between the slide die and a slide support.

FIG. 6 is a side view showing a bonding structure between the slide die 8 and the slide support 9. The slide die 8 is mounted to a stationary pin 16 fixed to the slide support 9 through a bearing mounted at a tip end of the stationary pin 16 for rotation about a rotational axis 14, and is connected to the slide support 9.

This structure ensures that the slide die 8 is easily rotatable about the rotational axis with a less resistance. As shown in FIG. 4, in the stationary die 7, a ring-shaped or a disk-shaped support plate 17 is placed on a bottom surface of the slide die 8 within a radially movable range, and the slide die 8 is supported by the support plate 17. The support plate 17 is movable in a direction toward the center axle 20 of the sacrificial pattern 18 for the impeller 1. To open the movable die 6 and the stationary die 7, the support plate 17 is moved away from the slide die 8 to provide a structure in which the rotation of the slide die 8 is permitted. At this time, the slide die 8 is supported by only the slide support 9. To close the dies, the support plate 17 is returned to its original position to provide a structure in which the rotation of the slide die is restrained.

In the present invention, it is important to determine of the rotational axis of the slide die. In a particular technique, the undercut in the radial direction of the space 10 shown in FIG. 2 can be searched by a three-dimensional model previously using CAD/CAM. In an alternate technique, at first, a partial model including two full blades adjacent to each other with one splitter blade interposed there between is made, and a plastic resin is poured into the partial model to produce a plastic resinous model. Then, the plastic resinous model is actually withdrawn from the partial model. Thus, the undercut can be searched by this test. The rotational axis 14 which is a motional line required for releasing the slide die 8 from the sacrificial pattern is determined by any of the above-described techniques. It is preferable that the direction of the perfect undercut which does not contact with the sacrificial pattern can be searched, but in fact, the sacrificial pattern is shrunk on the order of about 1% and hence, a space of several ten microns to several hundred microns is present between the slide die and the sacrificial pattern after the molding. In addition, even if the motional line for the slide die 8 interferes with the impeller 1 to a certain extent at the stage of a CAD/CAM analysis, because the sublimation pattern itself is resiliently deformed, the releasing of the die can be achieved without influence to the dimensional accuracy.

In the present invention, the above-described rotational axis 14 need not be necessarily perpendicular to the center axle 20 of the impeller 1 depending on the direction of the undercut, and intersecting the center axle 20. For example, the slide die 8 may be retreated at an angle of several degrees in the direction of the center axle 20.

A number of the above-described slide dies 8 corresponding to the number of the spaces 10 of the impeller are arranged annularly on the stationary die 7, as shown in FIG. 3, and the slide dies 8 and the movable die 6 and the stationary die 7 are brought into clamping close contact with one another to define a cavity corresponding to the form of the impeller 1. Then, a sacrificial material in a molten or semi-molten state is poured into the cavity for molding, using an injection-molding machine.

A particular motion in the radially retreating movement of the slide dies 8 from the sacrificial pattern at the releasing of the dies will be described below. After the pouring formation of the sacrificial pattern, the movable die 6 is moved away from the stationary die 7 for opening of the dies, as shown in FIG. 3. Then, the support plate 17 is moved away from the slide dies 8, whereby the slide dies 8 are supported by only the slide supports 9, so that they are permitted to be rotated. Then, as shown in FIG. 4, the slide supports 9 are drawn out in the radial direction of the center axle 20 along a plurality of grooves 19 formed radially in an upper surface of the stationary die 7. At this time, the slide supports 9 can be guided by guide pins 24 mounted at the bottoms of the slide supports 9, as shown in FIG. 6.

The slide dies 8 are connected the slide supports 9 by the stationary pin 16 through the bearing 15 placed on the rotational axis 14, as shown in FIG. 6, and hence, the slide dies 8 are naturally rotated for releasing without resistance about the rotational axis 14 along the full and splitter blade surface forms of the sacrificial pattern 18. The bearing 15 comprises inner and outer races, the inner race being fixed to the stationary pin 16, and the outer race being fixed to the slide die 8.

Figure 7:
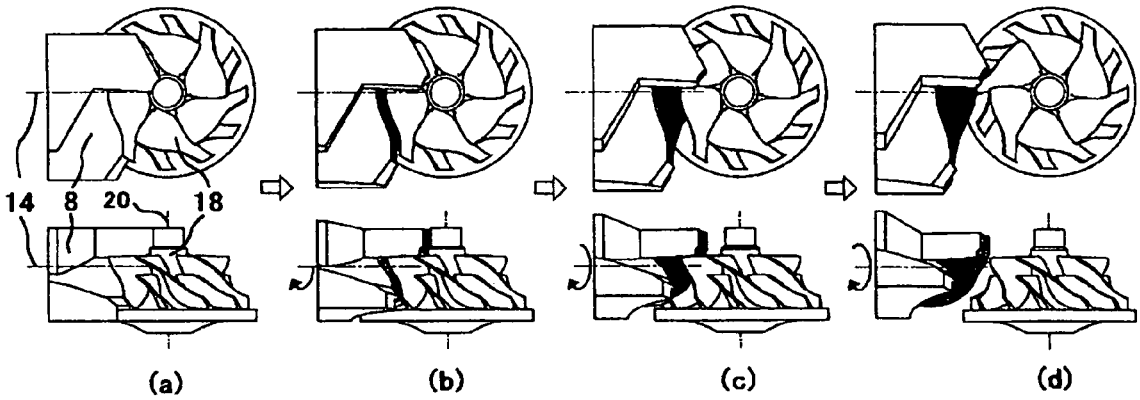
FIG. 7 schematically shows one example of the releasing operation of the slide die.

This particular rotational motion is shown in FIG. 7. For convenience, an area defining the cavity corresponding to the space 10 (shown in FIG. 2) of the slide die 8 is hatched in FIG. 7. This is for explaining the releasing motion of the slide die 8. FIGS. 7*a* to 7*d* show states in which the slide die 8 is being released from the sacrificial pattern 18. For the releasing, the slide dies 8 are rotated about the rotational axis 14, while being retreated, and they are finally released, as shown in FIG. 7*d*. In this manner, parting line-correspondence portions are formed in the space defined by the blades only on the trailing edge face 21, the fillet face 22 and the leading edge face 23 defining the outer periphery of the full blade 3. Namely, it is possible to produce the sacrificial pattern 18 with no parting line present at portions of the space 10 shown in FIG. 2, which correspond to the hub surface and the blade surface 5.

Figure 8:
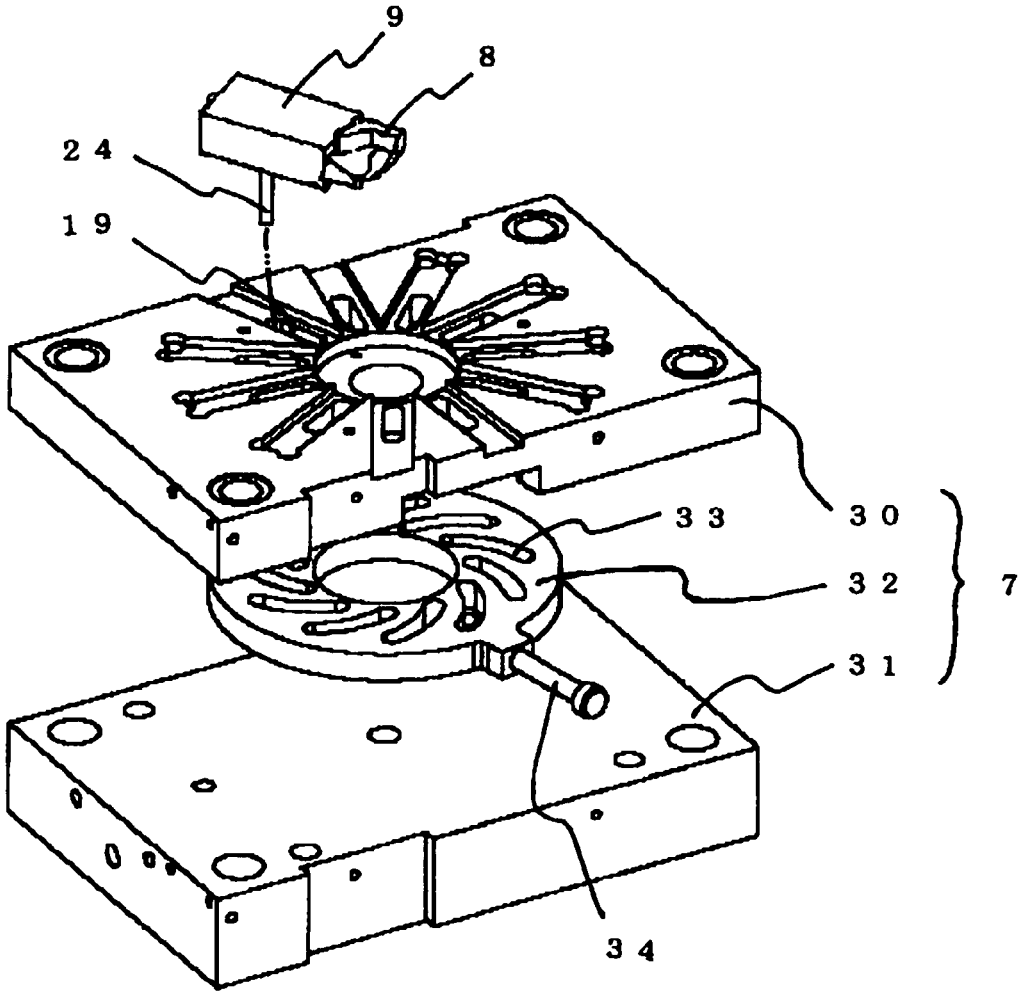
FIG. 8 schematically shows one example of an arrangement in which the slide dies can be moved in conjunction with one another.

A means for moving the slide supports 9, which can be employed, includes a method for manually retreating the individual slide supports, and preferably, a method for simultaneously withdrawing the slide supports connected integrally to one another in an interlocking structure. For example, as shown in FIG. 8, the stationary die 7 is comprised of a stationary die upper base 30, a stationary die lower base 31 and a cam plate 32 having cam grooves 33. The guide pin 24 of the individual slide support 9 is integrated with grooves 19 in the stationary die upper base 30 being in communication with the cam grooves 33. A drive lever 34, to which a drive device (not shown) such as a motor and a pressurizing cylinder is connected, is mounted on the cam plate 32, so that the individual slide supports can be moved in unison and in conjunction with one another by driving the cam plate 32 through the drive lever 34. Further, it is also preferable that the movement of the slide supports 9 is controlled automatically.

Then, a lost wax casting process using the produced sacrificial pattern is carried out. A plurality of the sacrificial patterns are assembled in a tree-configuration and coated with a refractory. In a case where an active metal such as a titanium alloy is cast, it is preferable that a stable refractory which less reacts with a molten titanium alloy is used as a coating material, e.g., a zirconia-based, yttria-based or calcia-based coating material is used as a first layer. It is preferable that a silica-based, alumina-based or zircon-based coating material is then coated. It is also preferable that the coating with the refractory is repeated a plurality of times for an intermediate layer and a backup layer, including the first layer. After the coating, it is preferable that the resulting sacrificial pattern is dried sufficiently and subjected to a dewaxing treatment in an autoclave. If the casting mold produced after the dewaxing is calcined at a high temperature, e.g., at 1000° C. or more, a casting mold having a high strength is completed.

When the impeller for the supercharger of the present invention is manufactured from a titanium alloy, it is preferable that a high-frequency induction melting using a water-cooled copper crucible is preferred for melting of the titanium alloy. In general, the titanium alloy is molten in vacuum of 733 Pa or less or in an atmosphere of an inert gas such as argon. The titanium alloy which can be used includes Ti-6Al-4V (JIS 60 type) or the like which is light in weight and high in strength and is generally used most widely. The titanium alloy is a material having a poor fluidity, but is preferred for the following reason: If a suction casting or a centrifugal casting is utilized, the fluidity of the titanium alloy is increased even for the formation of a thin-walled impeller, and the molten metal can be poured sufficiently.

When the impeller for the supercharger of the present invention is manufactured from an aluminum alloy, it is preferable that the melting of the aluminum alloy is carried out in a gas directly-heating furnace or an electrically indirectly-heating furnace. The melting may be carried out in the atmospheric air or in an atmosphere of an inert gas. The aluminum alloy which can be utilized includes, for example, AlSiMg-based AC4C and AC4CH or AlSiCu-based AC4B (JIS H2211) which has a high strength and a good vibration resistance. The aluminum alloy is not remarkably poor in castability, but is preferred, because if a suction casting or a vacuum casting is used, the fluidity of the aluminum alloy is increased even for the formation of a thin-walled impeller.

When the impeller for the supercharger of the present invention is manufactured from a magnesium alloy, it is preferable that the melting of the magnesium alloy is carried out in a gas directly-heating furnace or an electrically indirectly-heating furnace. The melting may be carried out in the atmospheric air or in an atmosphere of an inert gas. The magnesium alloy which can be utilized includes an MgZnZr-based ZK5Al or ZK6Al which has a strength and a toughness, or QE22A, EZ41A, ZC63A, WE43A, WE54A(JIS H2221) and the like which contains a rare earth element Y, Cu, Ag or the like added and which has a high-temperature strength. If a suction casting or a vacuum casting is utilized in the case of the magnesium alloy, as in the case of the aluminum alloy, the fluidity of the magnesium alloy is increased even for the formation of a thin-walled portion of an impeller and hence, the magnesium alloy is preferred.

After the casting using the titanium alloy, the aluminum alloy or the magnesium alloy which has been described above, the refractory, an unnecessary feeder head and the like are removed, and further, the cast product may be subjected to a surface treatment such as a sand-blasting treatment and a plating treatment. Thus, it is possible to produce an impeller made of the titanium alloy for superchargers, in which no parting line-correspondence portion is present in any of the hub surface and the blade surface in the space defined by the blades.

INDUSTRIAL APPLICABILITY

The present invention relates an impeller for use in a supercharger incorporated into an engine in an automobile or the like, and to a technique for manufacturing, in a lost wax casting process, the impeller whose high aerodynamic performance can be expected.

The invention claimed is:

1. A method of manufacturing an impeller for superchargers by a lost wax casting process utilizing a die device comprising a plurality of slide supports and a plurality of slide dies each of which is freely rotatably supported by a slide support, the impeller comprising:

a disk-shaped hub extending radially from a center axle; and a plurality of blades extending from the hub, which blades consist of alternately arranged full and splitter blades each having an aerodynamic curved surface, wherein a space defined by an each pair of the adjacent blades forms an undercut extending radially from the center axle, wherein the method comprises the following steps of:

a) forming a sacrificial pattern having substantially the same form as the impeller, b) coating the sacrificial pattern with a refractory material and subsequently thermally removing the sacrificial pattern to form a casting mold, and c) casting the impeller with utilization of the casting mold, and wherein the step (a) of forming the sacrificial pattern is a process of injecting a sacrificial material into a cavity defined by a plurality of slide dies which are arranged radially toward the center axle, and each of which has a groove, having a bottom of the same form as the splitter blade, and a form corresponding to that of a space between an adjacent pair of the full blades; and subsequently moving the slide dies radially outwardly, while freely rotating themselves around respective motional lines of the radially outwardly moving slide dies thereby releasing them from the sacrificial pattern.

2. The method according to claim 1, wherein a die device used in the step (a) of forming the sacrificial pattern comprises a movable die which moves in a direction of a center axle of forming the sacrificial pattern; a stationary die, the slide dies movable radially with respect to the center axle; and slide supports for supporting the slide dies, whereby the slide dies can be moved in conjunction with one another by driving the slide supports.

3. The method according to claim 1, wherein each of the slide dies comprises a plurality of cores bonded integrally with one another.

4. The method according to claim 1, wherein motional lines for releasing each of the slide dies from the sacrificial pattern are a motional line on XY coordinates on a two-dimensional plane, to which the center axle of the impeller is perpendicular, and a motional line including a rotational component around the motional line on the XY coordinates.

5. The method according to claim 4, wherein a die device used in the step (a) of forming the sacrificial pattern comprises a movable die which moves in a direction of a center axle of forming the sacrificial pattern; a stationary die, the slide dies movable radially with respect to the center axle; and slide supports for supporting the slide dies, whereby the slide dies can be moved in conjunction with one another by driving the slide supports.

6. The method according to claim 5, wherein each of the slide dies comprises a plurality of cores bonded integrally with one another.

7. The method according to claim 6, wherein any one of a titanium alloy, an aluminum alloy and a magnesium alloy is cast in the casting mold.

8. The method according to claim 7, wherein the casting mold is formed by coating the sacrificial pattern with any one of zirconia-based, yttria-based and calcia-based refractories, further coating the sacrificial pattern with any one of silica-based, alumina-based and zircon-based refractories, drying the refractory materials, thermally removing the sacrificial pattern in an autoclave, and calcining the resultant refractory materials at a high temperature.

9. The method according to claim 1, wherein the casting mold is formed by coating the sacrificial pattern with any one of zirconia-based, yttria-based and calcia-based refractories, further coating the sacrificial pattern with any one of silica-based, alumina-based and zircon-based refractories, drying the refractory materials, thermally removing the sacrificial pattern in an autoclave, and calcining the resultant refractory materials at a high temperature.

10. The method according to claim 1, wherein any one of a titanium alloy, an aluminum alloy and a magnesium alloy is cast in the casting mold.

11. The method according to claim 10, wherein the casting mold is formed by coating the sacrificial pattern with any one of zirconia-based, yttria-based and calcia-based refractories, further coating the sacrificial pattern with any one of silica-based, alumina-based and zircon-based refractories, drying the refractory materials, thermally removing the sacrificial pattern in an autoclave, and calcining the resultant refractory materials at a high temperature.

* * * * *